United States Patent [19]

Brumbalough

[11] Patent Number: 4,706,425

[45] Date of Patent: Nov. 17, 1987

[54] STAIR UNIT STRUCTURE

[76] Inventor: Jack J. Brumbalough, P.O. Box 1620, Maryville, Tenn. 37802

[21] Appl. No.: 860,086

[22] Filed: May 6, 1986

[51] Int. Cl.[4] ..... E04F 11/00

[52] U.S. Cl. ..... 52/182; 52/190

[58] Field of Search ..... 52/189, 190, 182, 184, 52/188

[56] References Cited

U.S. PATENT DOCUMENTS

| | | | |
|---|---|---|---|
| 615,634 | 12/1898 | Pease | 52/182 X |
| 2,697,931 | 12/1954 | Schill | 52/189 |
| 3,405,486 | 10/1968 | Fagenstrom | 52/190 |
| 4,599,835 | 7/1986 | Rinke | 52/184 |

FOREIGN PATENT DOCUMENTS

| | | | |
|---|---|---|---|
| 81583 | 3/1949 | Norway | 52/182 |

*Primary Examiner*—Carl D. Friedman

*Attorney, Agent, or Firm*—Pitts and Brittian

[57] ABSTRACT

A stair unit structure (10) having at least one stair (12) with a riser (14) and a tread (16) fabricated from rigid material such as fiberglass. A reinforcement member (24) is substantially coextensive with the width of the stair unit structure and is secured thereto by a suitable adhesive or the like. Preferably, a flange member (16) is provided proximate the lowermost riser to facilitate securing the structure (10) to the supporting structure. Further, a turn-down member (20) may be provided proximate the rearward edge of the upper most tread to provide added strength.

16 Claims, 4 Drawing Figures

STAIR UNIT STRUCTURE

DESCRIPTION

1. Technical Field

This invention relates generally to prefabricated stairs and more particularly concerns a stair unit structure fabricated from material such as fiberglass which is light weight and reinforced to support the weight of persons walking thereon.

2. Background Art

It will be appreciated by those skilled in the art that prefabricated stair units are frequently used in modern building construction. Further, these units can be readily moved into position proximate building structures. In this connection, there have been several attempts to provide prefabricated stair units capable of being used for entering and exiting buildings or the like. Known prior devices are illustrated in the following U.S. Pat. Nos.: 1,467,900; 2,703,005; 2,971,238; 3,706,170; and 3,380,337.

Each of these mentioned inventions disclose various features readily adoptable for prefabricated stair units. However, the known prior art suffers certain disadvantages and accordingly it is an object of the present invention to provide a stair unit structure which is lightweight, easily manufactured and which provides strength that is necessary and desired of such structures. Another object of the present invention is to provide such a structure which can be readily installed and secured to the supporting surface upon which the structure rests. Another object of the present invention is to provide means for reinforcing the stairs such that the strength is enhanced without a substantial loss in the portability of the unit.

DISCLOSURE OF THE INVENTION

Other objects and advantages will be obvious, and will in part appear hereinafter, and will be accomplished by the present invention which provides a stair unit structure having at least one stair with a riser and a tread and which is preferably fabricated from fiberglass. A reinforcement member is provided for selected treads and risers to enhance the strength of the structure. These members are preferably coextensive with the width of the structure and are secured thereto by a suitable adhesive. A flange member is provided proximate the lower most riser. This flange member extends outwardly to facilitate securing the stair unit structure to a supporting surface. A turndown member is provided proximate the upper tread to enhance its strength.

BRIEF DESCRIPTION OF THE DRAWINGS

The above mentioned features of the present invention will be more clearly understood from consideration of the following description in connection with accompanying drawings, in which.

BEST MODE FOR CARRYING OUT THE INVENTION

Figure 1:
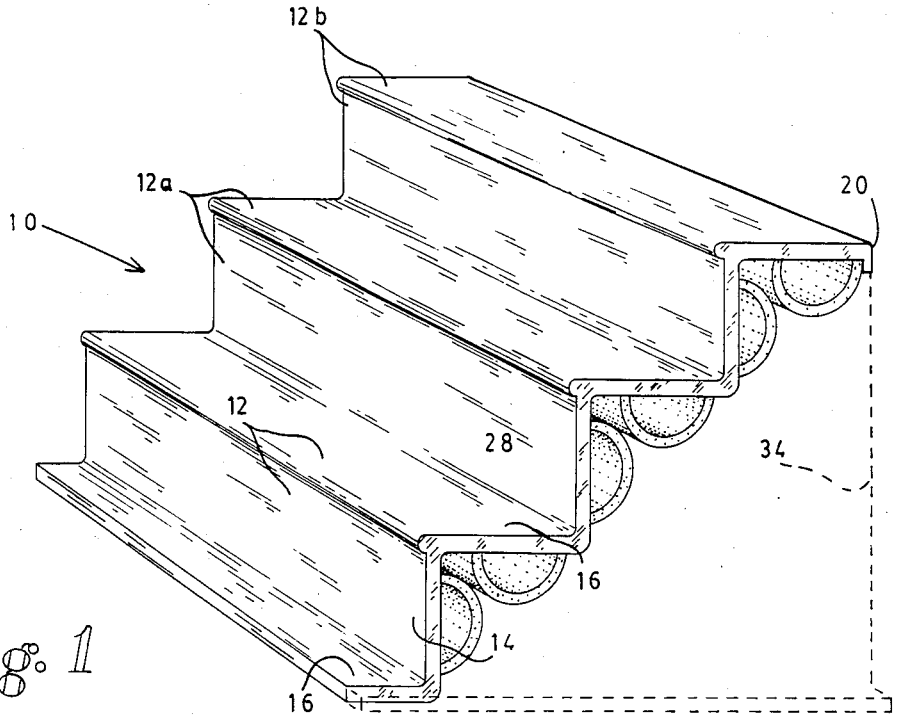
FIG. 1 represents a frontal perspective view of a stair unit structure constructed in accordance with various features of present invention.

Referring now to FIG. 1, a stair unit structure constructed in accordance with various features of the present invention is illustrated generally at 10. This stair unit structure 10 is preferably fabricated from a semi-rigid material capable of supporting the weight of a person or persons standing or climbing thereon. One suitable material has been found to be fiberglass, which can be readily molded to conform to a desired shape and configuration.

It will be noted in FIG. 1 that the stair unit structure 10 comprises stairs, such as a typical stair 12, which has a riser 14 and a tread 16. In the structure depicted in FIG. 1, a plurality of steps **12*a* and 12*b*** are illustrated.

Figure 3:
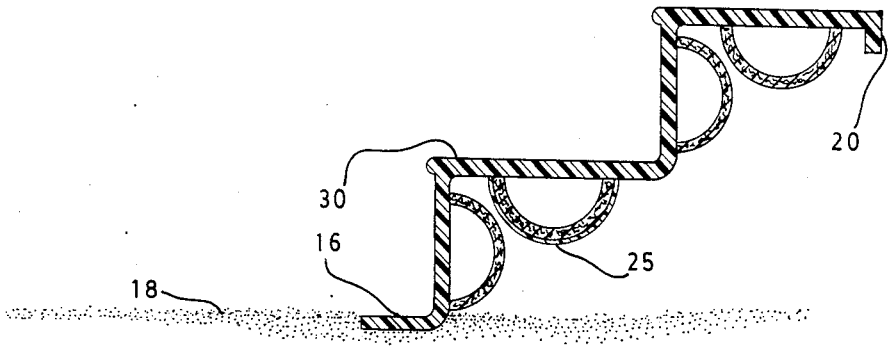
FIG. 3 illustrates a sectional side elevation view of the device illustrating FIG. 1.

It will be noted in FIG. 1 that the lowermost riser 14 associated with step 12 includes a flange member 16 which extends outwardly from the this riser as depicted in FIG. 1. This flange member is joined with the riser proximate its lowermost edge to facilitate securing the stair unit structure to a supporting structure such as is illustrated at 18 in FIG. 3.

In order to enhance the strength of the unit, the uppermost tread associated with stair step **12*b* includes a downwardly depending or turndown member 20, which enhances the strength of the stair unit structure proximate its upper and rearwardmost portion which is normally positioned adjacent the entrance to the building or platform to which access is gained by use of the stair unit structure 10**.

Figure 2:
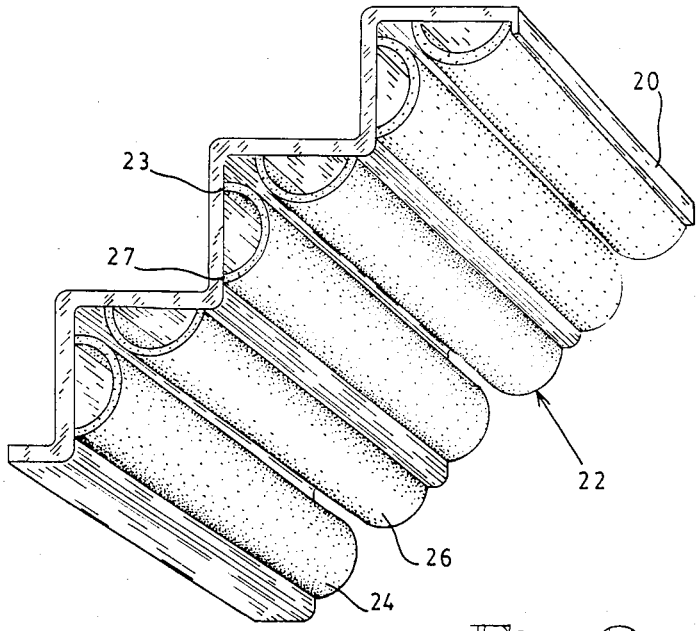
FIG. 2 illustrates a rearward perspective view illustrating certain features of the reinforcement members.

Reinforcement means are generally indicated at 22. The reinforcement means 22 serves to reinforce or strengthen the structure, and more specifically are attached to the surfaces or backsides of the tread and riser which are unexposed to the user. In the embodiments illustrated, the reinforcement means is joined with each of the risers and treads to provide added strength thereto and comprises a reinforcement member such as the members 24 and 26 which are secured to the unexposed surfaces of the riser and tread, respectively. It will be noted that each of the risers and treads in the embodiment depicted in FIG. 2 which are operatively associated with a stair step supporting the weight of a user, are provided with reinforcement means. However, the reinforcement members can be selectively joined with the risers and treads as necessary or desired. It will be noted that these reinforcement members are substantially coextensive with the width of the stair unit structure. Further, in the perferred embodiment the reinforcement members are hemitubular in cross-sectional outline defining opposite edges 23, 27, and opposite ends, and in a perferred embodiment are fabricated from a multi-ply paper tubing (such as is found in carpet rolls, for example) with the opposite edges secured to the treads and risers of the structure 10.

In this connection, means for securing the reinforcement members to the risers and treads is provided. This means generally comprises a suitable adhesive and in one embodiment, comprises a cloth member 25 which overlay members 24 and 26, shown in FIG. 2, and which is in turn overlayed and/or joined thereto by a suitable adhesive such as fiberglass or fiberglass resin. In this connection the reinforcement members and the cloth members are bonded with the structure.

In accordance with another feature of the present invention, the forward edge of each of the treads is rolled as indicated at 28 in FIG. 1. Similarly, as is necessary or desired, the side edges of the stair unit structure can be rolled at the location 30 depicted in FIG. 3. These rolled edges serve to provide an aesthetically pleasing appearance and enhance the strength of the structure. In accordance with another feature, the exposed surface of the treads or the step platform are roughened to assist in preventing slippage of the users foot or shoe thereon.

Figure 4:
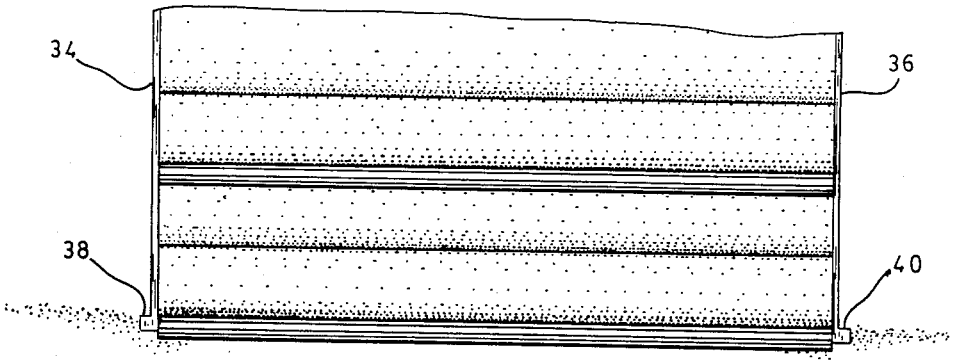
FIG. 4 illustrates a rear view of the device illustrated FIG. 1.

As shown in FIGS. 1 and 4, the stair unit structure 10 is provided with side closure panels 34 and 36 which cover the sides of the unit. These panels extend from the upper most tread to the lower most edge of the lowest step. It will be noted that flange members 38 and 40 are joined with the lower most edges of each of the side panels and engage the supporting surface 18. (See FIG. 4).

From the foregoing detailed description, it will be recognized by those skilled in the art that a stair unit structure has been described and illustrated which can be fabricated from a rigid or semi-rigid material capable of being readily moved yet having the strength sufficient for a person or persons walking thereon. In this connection, it is within the scope of the invention to fabricate the stair unit structure from a fiberglass material which can be readily molded into the shape and configuration desired. In the embodiment depicted, the lowermost riser is provided with an outwardly flared member which serves to secure the lower portion of the stair unit structure to a supporting surface. The uppermost tread of the stair unit structure is preferable provided with a turn-down member to enhance the strength of the structure. Suitable reinforcement is provided such that satisfactory strength exist without the need of a heavy structure.

Thus, although there has been described to this point particular embodiments of the present invention of a stair unit structure, it is not intended that such specific references be considered as limitations upon the scope of this invention except, insofar, as set forth in the following claims and equivalents thereof.

I claim:

1. A stair unit structure comprising:

at least one integrally formed stair step of a selected length having a riser member and a tread member fabricated from a semirigid material, said riser and tread members defining exposed surfaces and rear surfaces;

a hollow hemitubular reinforcement member defining longitudinal edges secured to said rear surface of at least one of said tread and riser members along said selected length to provide added strength thereto; and means for securing said longitudinal edges of said reinforcement members to said rear surface of at least one of said riser and said tread members.

2. The stair unit structure of claim 1 wherein a lowermost riser member includes a flange member extending outwardly therefrom proximate its lowermost edge to facilitate securing said stair unit structure to a supporting surface.

3. The stair unit structure of claim 1 wherein an uppermost tread member includes a turned-down flange member depending therefrom proximate a rearward edge of said uppermost tread member to provide added strength thereto.

4. The stair unit structure of claim 1 including a plurality of integrally formed stair steps each having a riser member and a tread member fabricated from fiberglass.

5. The stair unit structure of claim 4 wherein each tread member thereof includes a forward rolled edge.

6. The stair unit structure of claim 1 wherein said reinforcement members each comprise a hemitubular section of semirigid multiply paper tubing, and wherein said means for securing said longitudinal edges of said reinforcement member to said riser and said tread members comprises a fiberglass adhesive.

7. The stair unit structure of claim 1 wherein said means for securing said reinforcement members to said riser and said tread members comprises a cloth member for at least partially overlaying said reinforcement members and said fiberglass adhesive for bonding said reinforcement members and cloth member with said structure.

8. A stair unit structure comprising:

a plurality of integrally formed stair steps of a selected width each having a riser member and a tread member fabricated from fiberglass and defining exposed and rearward surfaces, each said stair steps having edge portions;

hollow hemitubular reinforcement members defining longitudinal edges with said longitudinal edges secured to said rearward surfaces of said riser and said tread members to provide added strength thereto, said reinforcement members being substantially coextensive with said selected width of said stair unit structure;

means for securing said longitudinal edges of said reinforcement members to said rearward surfaces of said riser and tread members; and a turned-down flange member depending proximate a rearward edge of a top tread member to provide strength thereto.

9. The stair unit structure of claim 8 wherein each tread member includes a forward rolled edge.

10. The stair unit structure of claim 8 wherein said reinforcement members each comprise a hemitubular section of semirigid multiply paper tubing and wherein said means for securing said reinforcement member to said riser and said tread comprises a fiberglass adhesive applied along said longitudinal edges.

11. The stair unit structure of claim 8 wherein said means for securing said reinforcement members to said riser and said tread members comprises a cloth member for at least partially overlaying said reinforcement members and fiberglass adhesive for bonding said reinforcement members and said cloth member with said structure.

12. The stair unit structure of claim 8 including closure panels integrally formed with said stair steps which cover said edge portion of said stair steps, each of said panels defining a flange extending outwardly therefrom at a lowermost edge for engaging a supporting surface.

13. A light weight, high strength stair unit structure, which comprises:

at least one stair step of a selected length having a riser member and a tread member integrally formed of a fiberglass composite, said riser and tread members defining exposed and rear surfaces;

hollow hemitubular reinforcement members fabricated from a semirigid, multiply paper, defining longitudinal edges, disposed proximate said rear surfaces of at least one of said riser and tread members and being substantially coextensive with said stair step along said selected length; and adhesive means joining said longitudinal edges of said hemi-tubular reinforcement members to said rear surfaces of said at least one of said riser and tread members.

14. The stair unit structure of claim 13 further comprises a fiberglass cloth fastened to at least a portion of said reinforcement members and to said rear surface with said adhesive means.

15. The stair unit structutre of claim 14 comprising a plurality of integrally formed stair steps, each having a riser member and a tread member defining exposed and rear surfaces, and wherein one of said reinforcing members is attached to said rear surface of each of said riser members and tread members with said fiberglass cloth and said adhesive means.

16. The stair unit structure of claim 15 further comprising end panels integrally formed with said riser and tread members.

* * * * *